US012704123B2

(12) United States Patent
Mueller et al.

(10) Patent No.: US 12,704,123 B2
(45) Date of Patent: Aug. 11, 2026

(54) RADIAL PISTON PUMP, AND PROCESS FOR MANUFACTURING A RADIAL PISTON PUMP

(71) Applicants: thyssenkrupp Dynamic Components GmbH, Ilsenburg (DE); thyssenkrupp AG, Essen (DE)

(72) Inventors: Ulf Mueller, Chemnitz (DE); Tim Mueller, Chemnitz (DE)

(73) Assignees: thyssenkrupp Dynamic Components GmbH, Ilsenburg (DE); thyssenkrupp AG, Essen (DE)

( * ) Notice: Subject to any disclaimer, the term of this patent is extended or adjusted under 35 U.S.C. 154(b) by 254 days.

(21) Appl. No.: 18/289,367

(22) PCT Filed: Apr. 29, 2022

(86) PCT No.: PCT/EP2022/061488

§ 371 (c)(1),
(2) Date: Nov. 2, 2023

(87) PCT Pub. No.: WO2022/238150

PCT Pub. Date: Nov. 17, 2022

(65) Prior Publication Data

US 2024/0240633 A1 Jul. 18, 2024

(30) Foreign Application Priority Data

May 10, 2021 (DE) ..... 10 2021 204 715.7

(51) Int. Cl.
*F04B 53/10* (2006.01)
*F04B 1/0421* (2020.01)
*F04B 53/22* (2006.01)

(52) U.S. Cl.
CPC ..... *F04B 53/1037* (2013.01); *F04B 1/0421* (2013.01); *F04B 53/22* (2013.01)

(58) Field of Classification Search
CPC ..... F04B 1/053; F04B 27/053; F04B 1/0404; F04B 39/1073; F04B 23/103
(Continued)

(56) References Cited

U.S. PATENT DOCUMENTS 2,434,734 A * 1/1948 Buschmann ..... F04B 39/1073 417/372
3,112,064 A 11/1963 Ayling
(Continued)

FOREIGN PATENT DOCUMENTS

CN 1497173 A 5/2004
CN 105041594 A 11/2015
(Continued)

OTHER PUBLICATIONS

English Translation of International Search Report issued in PCT/EP2022/061488, dated Jul. 15, 2022.

*Primary Examiner* — Mark A Laurenzi
*Assistant Examiner* — Benjamin Doyle
(74) *Attorney, Agent, or Firm* — thyssenkrupp North America, LLC

(57) ABSTRACT

Radial piston pump and a method of assembly of the radial pump in particular radial piston pump, including a drive shaft having an eccentric and at least one piston-and-working-chamber combination, wherein the piston-and-working-chamber combination comprises a cylinder bore and a piston, wherein the cylinder bore has a fluid outlet duct, the cylinder bore is closed with a cover, wherein the cover is received in a cover receptacle bore, the cylinder bore has a longitudinal axis, and the cover receptacle bore has a longitudinal axis, wherein the longitudinal axis of the cylinder bore and the longitudinal axis of the cover receptacle bore are not congruent, in particular are displaced in parallel.

14 Claims, 3 Drawing Sheets

(58) Field of Classification Search
USPC ..... 417/569, 570, 571, 273, 269, 454
See application file for complete search history.

(56) References Cited

U.S. PATENT DOCUMENTS 3,527,547 A * 9/1970 Dieter ..... F04B 53/1002 417/570
3,692,434 A * 9/1972 Schnear ..... F04B 39/128 417/273
3,784,331 A * 1/1974 Heidorn ..... F04B 27/04 417/273
4,352,640 A * 10/1982 Takamatsu ..... F04B 27/0409 417/273
4,358,251 A * 11/1982 Gannaway ..... F04B 27/053 417/319
4,721,443 A * 1/1988 Allen ..... F04B 39/1086 417/571
4,975,025 A * 12/1990 Yamamura ..... F04B 1/0413 92/61
4,990,065 A * 2/1991 Otaki ..... F04B 1/053 417/490
5,156,531 A 10/1992 Schmid et al.
5,180,292 A * 1/1993 Abousabha ..... F04B 27/053 181/403
5,249,935 A 10/1993 Burgdorf
5,358,383 A * 10/1994 Eisenbacher ..... F04B 53/1022 417/273
5,382,140 A * 1/1995 Eisenbacher ..... F04B 1/0426 417/273
5,571,243 A * 11/1996 Arnold ..... F02M 37/18 417/206
5,979,297 A * 11/1999 Ricco ..... F04B 1/0408 417/470
6,129,518 A * 10/2000 Ricco ..... F02M 39/00 417/253
6,135,735 A * 10/2000 Siegel ..... F04B 53/1002 417/567
6,322,328 B1 11/2001 Techet et al.
6,431,842 B1 * 8/2002 Furuta ..... F02M 59/44 123/495
6,439,859 B1 * 8/2002 de Matthaeis ..... F04B 53/007 417/470
6,514,050 B1 * 2/2003 Streicher ..... F04B 1/0404 417/440
6,568,927 B1 * 5/2003 Guentert ..... F02M 59/06 123/446
7,021,911 B2 * 4/2006 Moradmand ..... F04B 1/0404 417/570
7,048,521 B2 * 5/2006 Kondo ..... F04B 1/0452 417/570
2002/0009373 A1 * 1/2002 Ruthardt ..... F02M 37/04 417/454
2004/0013552 A1 * 1/2004 Kim ..... F04B 39/1073 417/569
2005/0008517 A1 * 1/2005 Iversen ..... F04B 39/1073 417/565
2009/0126695 A1 * 5/2009 Vu ..... F04B 1/0452 123/198 C
2009/0136365 A1 * 5/2009 Zippl ..... F04B 39/125 417/312
2014/0076443 A1 * 3/2014 Cesak ..... F04B 39/06 137/855

FOREIGN PATENT DOCUMENTS

DE 44 01 074 A1 7/1995
DE 19507295 A1 9/1996
DE 102008015548 A1 10/2009
DE 102008002178 A1 12/2009
DE 102009047568 A1 6/2011
EP 2 708 746 A1 3/2014
WO 9858171 A2 12/1998

* cited by examiner

Fig.1
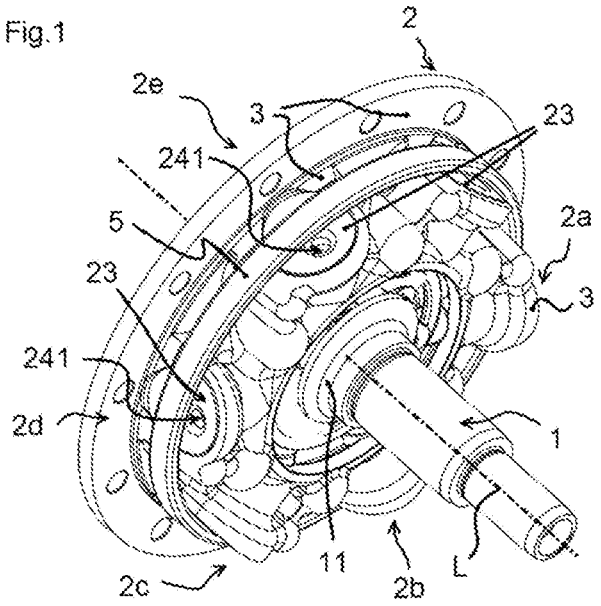
Fig.2
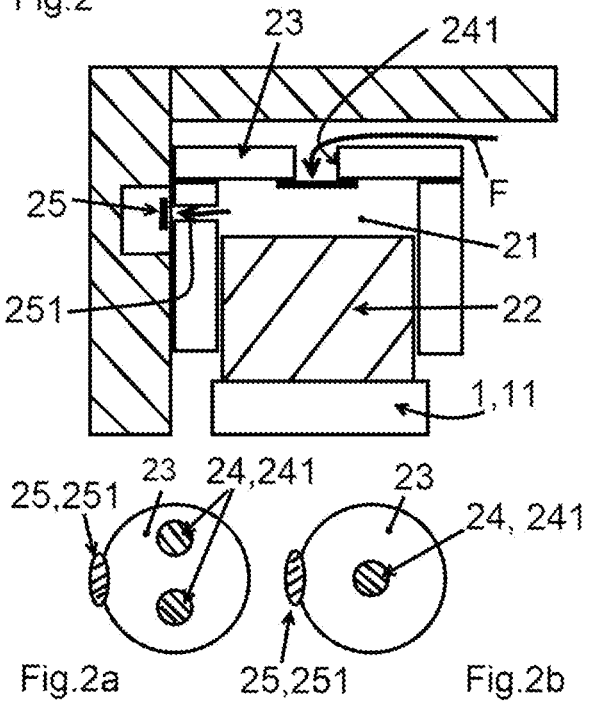
Fig.2a Fig.2b

RADIAL PISTON PUMP, AND PROCESS FOR MANUFACTURING A RADIAL PISTON PUMP

CROSS REFERENCE TO RELATED APPLICATIONS

This application is a U.S. National Stage Entry of International Patent Application Serial Number PCT/EP2022/061488, filed Apr. 29, 2022, which claims priority to German Patent Application No. DE 10 2021 204 715.7, filed May 10, 2021, the entire contents of which are incorporated herein by reference.

FIELD

The present disclosure relates to a radial piston pump, in particular radial piston compressor, and a method of assembly.

BACKGROUND

A radial piston pump is an element in fluidics. In this pump, also referred to as a pump based on the principle of a radial piston, the piston-and-working-chamber combinations are disposed radially and perpendicularly to the drive shaft—as opposed to an axial piston compressor. The delivery or stroke movement of each individual working piston is caused by an eccentric which is situated on the drive shaft. The radial piston pump typically comprises a plurality of piston-and-working-chamber combinations which extend radially, in a star-shaped manner, from the drive shaft. The radial piston pump pumps a fluid from a low-pressure chamber into a high-pressure chamber.

Radial piston pumps are used, for example, as compressors for coolant in air-conditioning systems of motor vehicles, in particular also in electrically driven motor vehicles. A radial piston pump may also be referred to as a radial piston compressor, or a refrigerant compressor operating according to the radial piston principle.

The valves for the gas exchange procedure in a radial piston pump of this type are disposed as follows. The inlet valves are disposed radially in terms of the rotation axis of the eccentric shaft, i.e. close to the head-end of the respective piston. In contrast, the outlet valves are disposed axially, which offers advantages in terms of the installation space and also offers more freedom in terms of the design of the inlet valves; a larger valve diameter, a larger bending length, potentially more inlet valves, etc. can, for example, be produced.

For functional reasons, a minimum wall thickness is required in the cylinder housing, in particular between the cover seat and the resting face of the outlet valve in the high-pressure duct. Owing to the axial disposal of the outlet valve plate, a "non-compressible volume", the so-called "dead volume/distressed volume" is additionally created over the width of the cylinder housing up to the outlet valve, and thus up to the outlet duct, as a result of the piston movement. The dead volume is derived from the cross-sectional area thereof x duct length. It is an objective to keep this dead volume as small as possible, as it compromises the efficiency of the compressor. For reasons of design, the outlet duct (cavity which forms a fluidic connection between the compression chamber and the high-pressure duct) is situated as high "up" as possible in the cylinder chamber, close to the cover end face. The exit face of the outlet duct (in the high-pressure chamber) is closed by the outlet valve plate in that the plate projects beyond the exit face of the outlet duct (projection), thus axially sealing the duct.

Since the cover requires an axial resting face for precise positioning in relation to the cylinder housing, the length of the outlet duct (when configuring a planar sealing face for the outlet valve plate) is enlarged by the projection of the cover (radial projection of cover receptacle bore in relation to cylinder bore), which leads to a larger dead volume. In this regard, reference may be made to FIGS. 1 to 3 for a radial piston compressor according to the prior art.

According to the disclosure, this object is achieved by a radial piston pump, in particular radial piston compressor. Owing to the fact that the longitudinal axis of the cylinder bore and the longitudinal axis of the cover receptacle bore are not congruent, in particular are displaced in parallel, the disadvantages outlined above are overcome, or at least minimized. In particular, a reduced dead volume is derived by way of shortening the length of the outlet duct. Nevertheless, a sufficient axial resting face for the assembly of the cover does remain. Furthermore, this results in a positioning possibility for securing elements in the cover resting face, in particular owing to the decoupling of the axes of the pre-assembled module "cover inlet valve". Furthermore, this enables the use of simple geometric functional elements, in particular circular bores, easy and reliable sealing, low costs.

Further advantageous design embodiments of the disclosure are described below. The subject matter, or features, of the various claims can in principle be combined with one another in an arbitrary manner.

In one advantageous design embodiment of the disclosure it can be provided that the cover receptacle bore is disposed so as to be eccentric in relation to the cylinder bore.

In one further advantageous design embodiment of the disclosure it can be provided that the longitudinal axis of the cylinder bore in terms of the longitudinal axis of the cover receptacle bore is displaced in the direction of the fluid outlet duct, or away from the fluid outlet duct. In this way, the fluid outlet duct can advantageously be shortened, and the dead volume can thus be advantageously reduced.

In one further advantageous design embodiment of the disclosure it can be provided that a step is provided between the cylinder bore and the cover receptacle bore, which step forms, at least indirectly, the bearing face for a peripheral region of the cover. For example, an inlet valve, in particular in the form of a spring plate valve, can be deposited on a step of this type. In this instance, the inlet valve is preferably disposed between the cover and the step so that the cover rests indirectly on this step.

In one further advantageous design embodiment of the disclosure it can be provided that the cylinder bore and the cover receptacle bore have different diameters, the cover receptacle bore having in particular a larger diameter than the cylinder bore. In principle, a completely encircling step can be achieved as a result, for example.

In one further advantageous design embodiment of the disclosure it can be provided that the radial piston pump, in particular the piston-and-working-chamber combination, has a fluid inlet duct having an inlet valve, and the fluid outlet duct having an outlet valve, wherein the fluid inlet duct is aligned radially in relation to the drive shaft, and the fluid outlet duct is aligned axially.

In one further advantageous design embodiment of the disclosure it can be provided that the fluid inlet duct is provided in the cover or the piston. Depending on the arrangement of the fluid inlet duct in the cover or the piston, in particular space-saving advantages in terms of construction can be derived.

In one further advantageous design embodiment of the disclosure it can be provided that the inlet valve, in particular an inlet valve designed as a spring plate valve, rests on the step. The inlet valve can be disposed between the cover and the step, and prior thereto be connected to the cover, as is yet to be discussed hereunder.

In one further advantageous design embodiment of the disclosure it can be provided that the inlet valve is fastened to the cover by means of a securing element, in particular by means of a groove pin. An advantageous assembly and disassembly can be guaranteed as a result, due to the fact that the cover and the inlet valve form an assembly unit.

In one further advantageous design embodiment of the disclosure it can be provided that the securing elements are disposed between the cover and the step. Accordingly, the securing elements are disposed outside the cylinder bore and there is no fundamental risk of the securing elements inadvertently entering the working chamber of the piston, i.e. the cylinder bore.

In one further advantageous design embodiment of the disclosure it can be provided that there are clearances in the step for at least partially receiving the securing elements, in particular the groove pins, in the step. The securing elements can in portions plunge into the clearances, this representing an additional securing measure preventing the securing elements from inadvertently entering the working chamber.

A further object of the present disclosure lies in proposing an advantageous and/or improved method for assembling a radial piston pump.

According to the disclosure, this object is achieved by a method including placing the inlet valve on the cover, fixing the inlet valve to the cover by means of at least one securing element, preferably by means of a groove pin, placing the cover on the step by way of the valve side, wherein the at least one securing element is disposed between the cover and the step, and fixing the cover in the cover receptacle bore.

Further advantageous design embodiments of the disclosure are described below. The subject matter, or features, of the various claims can in principle be combined with one another in an arbitrary manner.

BRIEF DESCRIPTION OF THE FIGURES

So that those skilled in the art to which the subject invention appertains will readily understand how to make and use the devices and methods of the subject invention without undue experimentation, preferred embodiments thereof will be described in detail herein below with reference to certain figures, wherein:

FIG. 1 shows a radial piston pump in a perspective view.

FIG. 2 shows a schematic illustration of a radial piston pump having a radial inlet valve and an axial outlet valve.

DETAILED DESCRIPTION

Figure 3:
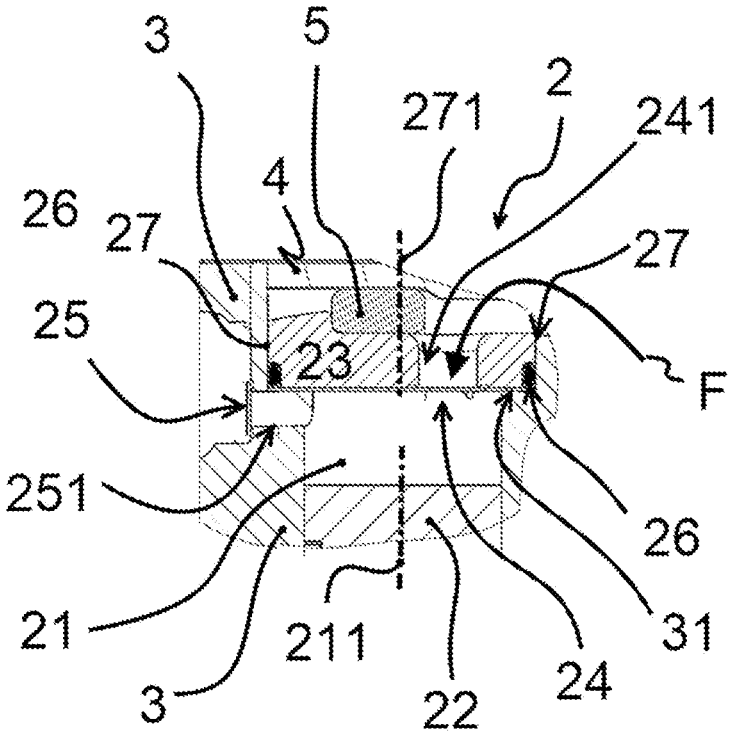
FIG. 3 shows an enlarged illustration of the radial piston pump.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The following reference signs are used in the images:

L Longitudinal axis
F Fluid
1 Drive shaft
2(*a-e*) Piston-and-working-chamber combination
3 Pump main body
4 Housing
5 Retaining ring
6 Securing element, in particular groove pin
11 Eccentric
21 Cylinder bore
22 Piston
23(*a-e*) Cover
24 Inlet valve
25 Outlet valve
26 Seal
27 Cover receptacle bore
31 Step/bearing face
211 Symmetry axis/Longitudinal axis (cylinder bore)
241 Fluid inlet duct
251 Fluid outlet duct
271 Symmetry axis/Longitudinal axis (cover receptacle bore)
311 Clearance for securing element Features and details herein which are described in the context of a method of course also apply to the device according to the invention and vice versa, so that reference is always made, or may be made, in a reciprocating manner between the disclosures pertaining to the individual aspects of the invention. Moreover, a method according to the invention potentially described can be carried out by the device according to the invention.

The terminology used herein serves merely the purpose of description of certain embodiments and is not intended to restrict the disclosure. As used herein, the singular forms "a/an" and "the" are also intended to comprise the plural forms, unless the context clearly indicates otherwise. In addition, it will become clear that the expressions "has" and/or "having", when used in this description, specify the presence of the indicated features, integers, steps, operations, elements and/or components, but do not rule out the presence or the addition of one or more other features, integers, steps, operations, elements, components and/or groups. As used herein, the expression "and/or" comprises every arbitrary element and all combinations of one or more of the associated, listed elements.

Reference is first made to FIGS. 1 to 3.

A radial piston pump comprises substantially a drive shaft 1 having an eccentric 11 and at least one piston-and-working-chamber combination 2. A longitudinal axis L of the drive shaft 1 is plotted in FIG. 1 for defining the axial direction. The combination of the drive shaft 1 and the eccentric 11 can also be referred to as an eccentric shaft. The present eccentric shaft preferably comprises a circular eccentric, offering the advantage that a roller bearing can be pushed onto the circular eccentric, which reduces contact friction and contact speed (between the circular eccentric and the piston).

The piston-and-working-chamber combination 2 comprises substantially a cylinder bore 21 and a piston 22. The cylinder bore 21 at the head-end is closed by a cover 23. With a view to the drive shaft 1, the cylinder bore 21 and the cover 23 are in this way preferably disposed behind one another in the radial direction.

The cylinder bore 21 is preferably designed so as to be circular-cylindrical. The cylinder bore 21 accordingly has a symmetry axis, or longitudinal axis 211, in the direction of the movement of the piston.

The radial piston pump typically comprises at least two piston-and-working-chamber combinations 2, 2*a*, 2*b*, . . . , which extend radially from the drive shaft 1. The radial piston pump preferably comprises at least three, preferably six, piston-and-working-chamber combinations 2, 2*a*, 2*b*, . . . , which correspondingly extend in a star-shaped manner from the drive shaft 1. Accordingly, each cylinder bore 21 of the piston-and-working-chamber combinations 2, 2*a*, 2*b*, . . . is provided with a cover 23, 23*a*, . . . .

The cylinder bore, or the cylinder bores 21, is/are preferably received by a pump main body 3, or formed by the latter. Accordingly, the pump main body 3 is preferably a casting. The pump main body 3 in turn can at least be partially enclosed by a housing 4.

The cover or covers 23, 23*a*, . . . , here by way of example, are fixed to the pump main body 3, or above the cylinder bore or cylinder bores 21, by means of a retaining ring 5. In principle however, any other suitable type of fastening such as, a screw connection for example, or else a retaining ring integrated in the housing, can also be considered. The housing 4 engages across the retaining ring 5.

Furthermore provided in the cover 23, or at the head-end of the cylinder bore 21, is a fluid inlet duct 241. The fluid inlet duct 241 is equipped with an inlet valve 24 which can selectively close or release the fluid inlet duct 241. The fluid inlet duct 241 can also be provided in the piston 22, for example. The fluid inlet duct 241 is preferably disposed radially.

The cover 23 is preferably designed so as to be circular. The cover 23 is received in a corresponding, preferably likewise circular, cylindrical cover receptacle bore 27 provided for this purpose. The cover receptacle bore 27 is preferably provided in the pump main body 3. Accordingly, the cover receptacle bore 27 has a symmetry axis, or a longitudinal axis 271. With a view to the production costs and the functional requirement in terms of the tightness of the cover 23 in relation to the cylinder bore 21, or in relation to the pump main body 3, a circular shape is preferable for the geometry of the cover 23 and the cover receptacle bore 27.

The cover receptacle bore 27 for the cover 23 preferably has a larger diameter than the cylinder bore 21 so that a step 31 results between the two bores. This step serves at least indirectly as a bearing face 31 for the cover 23. It is provided in particular that an inlet valve 24, preferably designed as a spring plate valve, first rests on the step 31, and the cover 23 having the fluid inlet duct then rests on the spring plate valve 24.

A fluid outlet duct 251 is also provided in the cylinder bore 21, preferably in the wall of the cylinder bore 21. The fluid outlet duct 251 is equipped with an outlet valve 25 which can selectively close or release the fluid outlet duct 251. The fluid outlet duct 251 is preferably disposed axially.

As is illustrated in FIG. 2, for example, the fluid F to be compressed flows, by way of the fluid inlet duct 241, or the inlet valve 24, into the cylinder bore 21, is there compressed by the stroke movement of the piston 22, and exits the cylinder bore 21 through the outlet valve 25, or the fluid outlet duct 251. The design embodiment of the valves, for example as a spring plate valve, is well known to the person skilled in the art and does not require any further explanation. Various design possibilities or variations, in particular in terms of the number of inlet/outlet valves, in particular also per piston-and-working-chamber combination 2, are also conceivable.

It is provided according to the invention that the longitudinal axis 211 of the cylinder bore 21 and the longitudinal axis 271 of the cover receptacle bore 27 are not congruent. In other words, it is preferably provided that the longitudinal axis 271 of the cover receptacle bore 27 is displaced in parallel to the longitudinal axis 211 of the cylinder bore 21, or the cover receptacle bore 27 is disposed so as to be eccentric in relation to the cylinder bore 21. Such an arrangement can be seen in FIGS. 4 and 5, for example. It can furthermore be seen here that the cover 23 is likewise disposed so as to be displaced in parallel, or eccentrically, in relation to the cylinder bore 21, and thus ultimately in relation to the piston 22.

It is preferably provided to this end, that the longitudinal axis 211 of the cylinder bore 21 with a view to the longitudinal axis 271 of the cover receptacle bore 27 is displaced in the direction, or counter to the direction, of the fluid outlet duct 251. As a result, the fluid outlet duct 251 can be adapted, in particular designed so as to be shortened, as can be seen in particular by comparing FIGS. 3 and 4. It is shown in principle that the bearing contact becomes larger on the side facing away from the high-pressure duct, the cover thus tending to be re-positioned away from the high-pressure region. Furthermore shown is the relative re-positioning of the inlet region in the cover in relation to the cylinder. The version "away from the high-pressure region" is preferable.

While an axial re-positioning (eccentricity) of the cover 23 in the axial direction in relation to the cylinder bore 21 is illustrated in the images, a displacement of the longitudinal axis 271 of the cover receptacle bore 27 in the direction offset by 90° in relation to the abovementioned direction, or any direction in between, is also conceivable, thus also into the drawing plane or out of the latter, for example.

Figure 4:
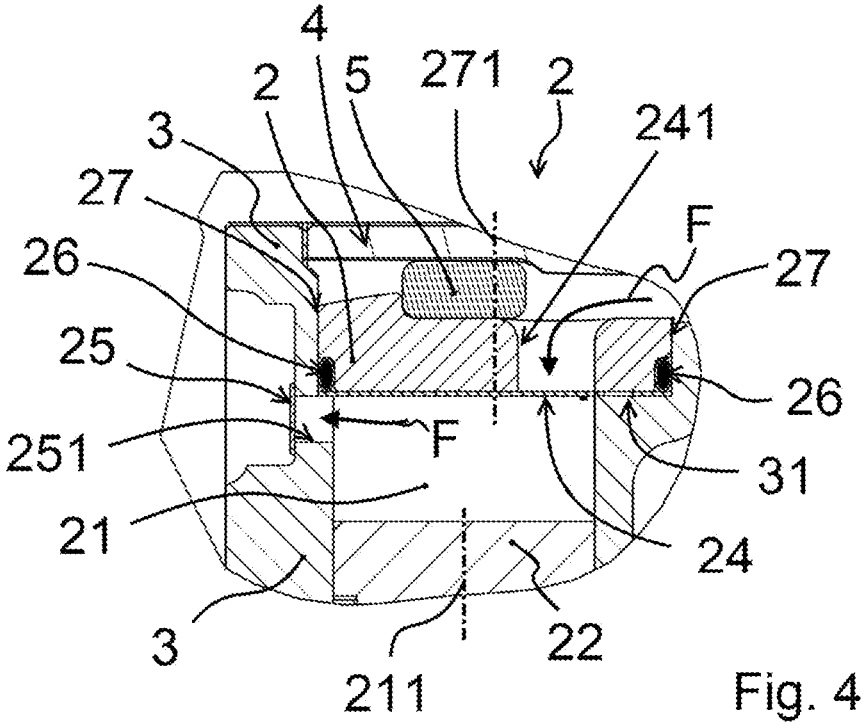
FIG. 4 shows an enlarged illustration of the radial piston pump according to the invention.
Figure 5:
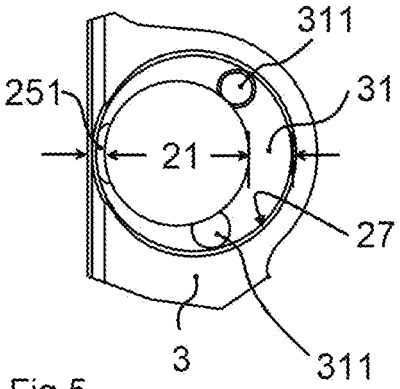
FIG. 5 shows a view from above of a piston-and-working-chamber combination, in particular a cover of a radial piston pump according to the disclosure.
Figure 6:
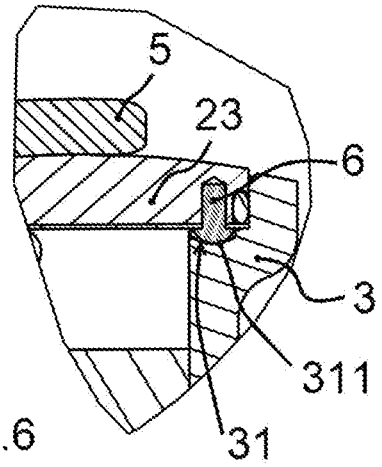
FIG. 6 shows a detail of a radial piston pump according to the disclosure, in particular a groove pin.
Figure 7:
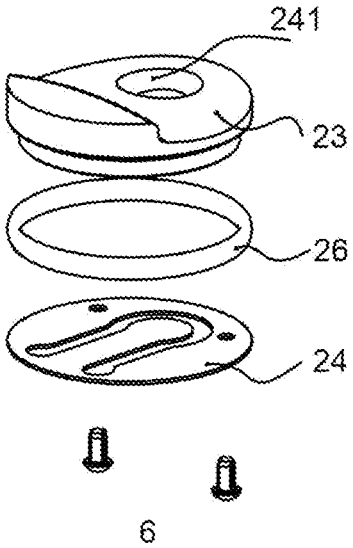
FIG. 7 shows an exploded illustration of a cover, a seal, a valve and a groove pin of a radial piston pump according to the disclosure.

FIG. 4 furthermore shows a fragment of a radial piston compressor having an axially aligned outlet duct 251. The position of the piston 1 is illustrated as a partial stroke.

Further details of the present invention are derived from the description of an advantageous assembly of the radial piston pump, in particular of the combination of the cover 23 and the inlet valve 24.

The assembling of the "cover module" on the pump main body 3 preferably is performed as an "overhead assembly" for the inlet valve 24. It is therefore advantageous for the inlet valve 24 in a pre-assembly step to be captively fastened to the cover 23. At least one securing element, hereunder illustrated as groove pins 6, can be provided for this purpose, which in the process are to be disposed such that their release during operation either cannot take place or does not have any negative influence on the function of the radial piston pump.

It is provided to this end that the securing elements 6 are accommodated between the cover and the step. In this way, the securing elements, in particular groove pins, cannot enter the cylinder bore 21 if released. For this purpose, at least one clearance 311 is preferably provided in the step 31, into which the securing elements 6, in particular the groove pins, or their heads, can plunge.

With a view to a preferred assembly method, the assembly in the case of a radial piston pump, comprising an inlet valve, preferably a spring plate valve, and a cover 23 having a fluid inlet duct 241, and a step 31 provided between the cylinder bore 21 and the cover receptacle bore 27, preferably takes place as follows:

placing the inlet valve 24 on the cover 23;

fixing the inlet 24 to the cover 23 by means of at least one securing element 6, preferably by means of a groove pin;

placing the cover 23 on the step 31 by way of the valve side, wherein the securing elements 6 are disposed between the cover 23 and the step 31;

fixing the cover 23 in the cover receptacle bore 27.

The assembly method can preferably likewise comprise the assembly of the seal 26 on the cover (O-ring).

It can preferably be provided here that the securing elements, in particular the groove pins, are in portions received in clearances 311 of the step 31.

The radial piston pump proposed here can preferably be used as an air conditioning compressor, or a refrigerant compressor, preferably having an electric motor as a drive. Accordingly, the fluid is preferably a refrigerant.

What is claimed is:

1. A radial piston pump comprising:

a drive shaft having at least one piston-and-working-chamber combination, wherein the piston-and-working-chamber combination comprises a cylinder bore and a piston, wherein, the cylinder bore has a fluid outlet duct extending radially through a circumferential outer wall of the cylinder bore, the cylinder bore is closed with a cover, wherein the cover is received in a cover receptacle bore, the cylinder bore has a longitudinal axis, and the cover receptacle bore has a longitudinal axis, and the longitudinal axis of the cylinder bore and the longitudinal axis of the cover receptacle bore are not congruent;

wherein the radial piston pump includes a fluid inlet duct having an inlet valve;

wherein the fluid outlet duct has an outlet valve;

wherein the fluid inlet duct is aligned radially in relation to the drive shaft, and the fluid outlet duct is aligned axially in relation to the drive shaft;

wherein a step is provided between the cylinder bore and the cover receptacle bore, which step forms a bearing face for a peripheral region of the cover;

wherein the inlet valve is fastened to the cover by means of at least one securing element.

2. The radial piston pump of claim 1, wherein the cover receptacle bore is disposed so as to be eccentric in relation to the cylinder bore.

3. The radial piston pump of claim 1, wherein the longitudinal axis of the cylinder bore in terms of the longitudinal axis of the cover receptacle bore is displaced in the direction of the fluid outlet duct, or away from the fluid outlet duct.

4. The radial piston pump of claim 1, wherein the cylinder bore and the cover receptacle bore have different diameters.

5. The radial piston pump of claim 1, wherein the fluid inlet duct is provided in the cover or the piston.

6. The radial piston pump of claim 1, wherein the inlet valve bears on the step.

7. The radial piston pump of claim 1, wherein the at least one securing element is disposed between the cover and the step.

8. The radial piston pump of claim 1, wherein the step is at least one clearance for at least partially receiving the at least one securing element in the step.

9. A method for assembling the radial piston pump of claim 1 comprising:

placing the inlet valve on the cover;

fixing the inlet valve to the cover by means of at least one securing element;

placing the cover on the step by way of the valve side, wherein the at least one securing element is disposed between the cover and the step; and fixing the cover in the cover receptacle bore.

10. The method of claim 9, wherein, the at least one securing element is received in portions in at least one clearance of the step.

11. The method of claim 9 wherein the securing element is a groove pin.

12. The radial piston pump of claim 1 wherein the longitudinal axis of the cylinder bore and the longitudinal axis of the cover receptacle bore are displaced in parallel.

13. The radial piston pump of claim 1 wherein the securing element is a groove pin.

14. The radial piston pump of claim 8 wherein the securing element is a groove pin.

* * * * *